United States Patent [19]

Takebe

[11] Patent Number: 4,525,076

[45] Date of Patent: Jun. 25, 1985

[54] VOCAL ANNOUNCING DEVICE FOR ELECTRONIC TIMEPIECE

[75] Inventor: Katuhiko Takebe, Machida, Japan

[73] Assignee: Rhythm Watch Company Limited, Tokyo, Japan

[21] Appl. No.: 190,356

[22] Filed: Sep. 24, 1980

[30] Foreign Application Priority Data

Sep. 29, 1979 [JP] Japan ..... 54-126145

[51] Int. Cl.[3] ..... G04B 21/08

[52] U.S. Cl. ..... 368/63

[58] Field of Search ..... 368/63, 273, 274, 272, 368/244, 245

[56] References Cited

U.S. PATENT DOCUMENTS 3,420,051 1/1969 Matteson ..... 368/63
3,507,110 4/1970 Milatz ..... 368/63
4,271,495 6/1981 Scherzinger et al. ..... 368/273 X
4,279,030 7/1981 Masuzawa et al. ..... 368/63
4,282,593 8/1981 Flaig et al. ..... 368/273 X

FOREIGN PATENT DOCUMENTS 54-153070 12/1979 Japan ..... 368/63

*Primary Examiner*—Philip H. Leung
*Attorney, Agent, or Firm*—Koda and Androlia

[57] ABSTRACT

A vocal announcing device for an electronic timepiece in which background sounds are overlappingly performed with vocal announcement during vocal announcement, in which indicated time of timepiece is not only vocally announced but also background sounds are performed to overlap the vocal announcement, and in which background sounds are performed to overlap vocal alarming sounds of timepiece.

1 Claim, 1 Drawing Figure

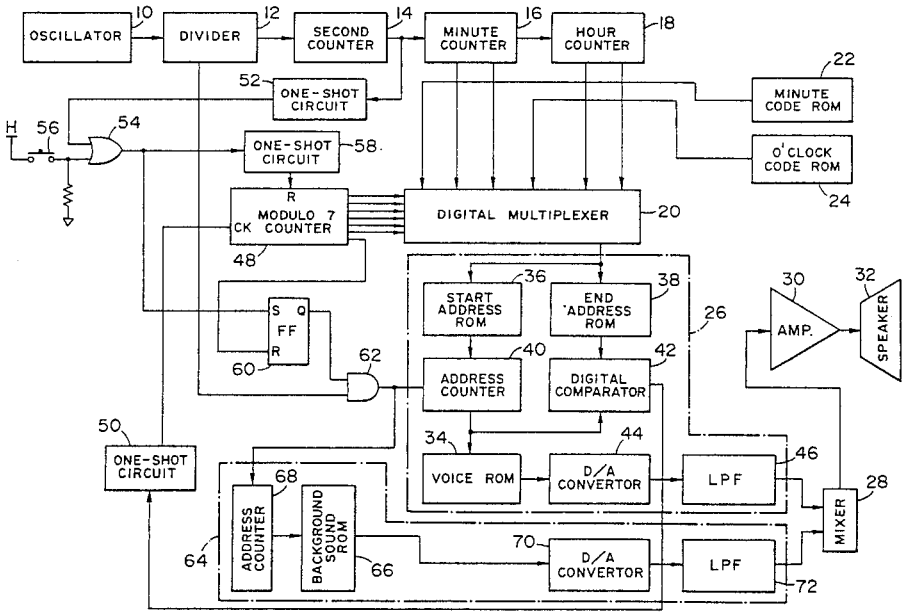

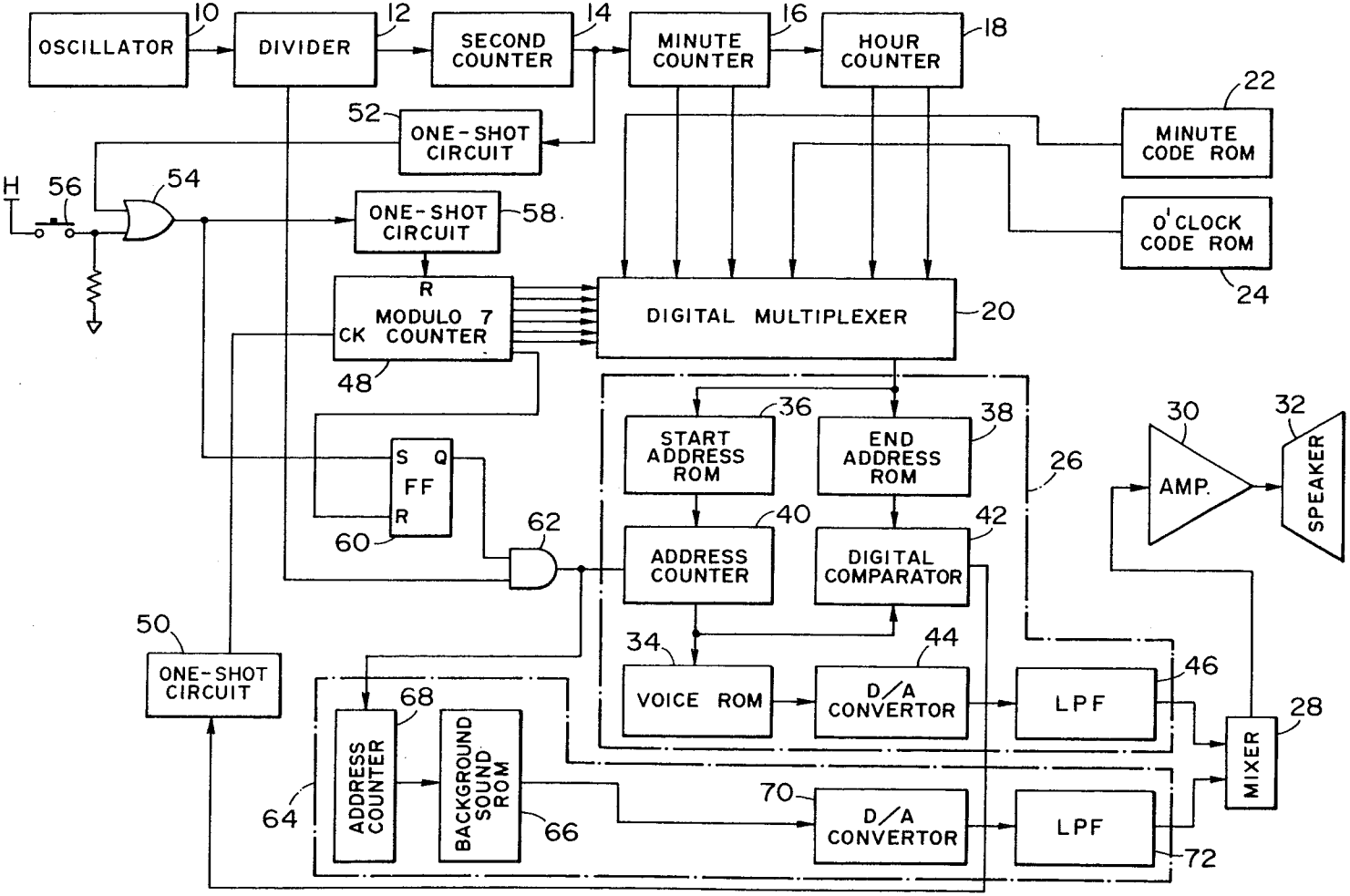
OSCILLATOR
DIVIDER
SECOND COUNTER
MINUTE COUNTER
HOUR COUNTER
MINUTE CODE ROM
O'CLOCK CODE ROM
ONE-SHOT CIRCUIT
ONE-SHOT CIRCUIT
R
MODULO 7 COUNTER
CK
DIGITAL MULTIPLEXER
END ADDRESS ROM
START ADDRESS ROM
DIGITAL COMPARATOR
ADDRESS COUNTER
VOICE ROM
D/A CONVERTOR
D/A CONVERTOR
LPF
LPF
MIXER
AMP.
SPEAKER
S Q
FF
R
ONE-SHOT CIRCUIT
ADDRESS COUNTER
BACKGROUND SOUND ROM
H
10
12
14
16
18
20
22
24
26
28
30
32
34
36
38
40
42
44
46
48
50
52
54
56
58
60
62
64
66
68
70
72

VOCAL ANNOUNCING DEVICE FOR ELECTRONIC TIMEPIECE

BACKGROUND OF THE INVENTION

1. Field of Invention

The present invention relates to a vocal announcing device for an electronic timepiece, more particularly to a vocal announcing device for an electronic timepiece which enables to read out voice signals which are previously memorized in a voice ROM corresponding to an indicated time on a clock or the other information such as alarm, etc.

2. Description of Prior Art

There has been offered such device that announces an indicated time on a clock or performs an alarming action at the set time with voice. By this kind of clock the time can be known through ears even in such difficult conditions to read the time as in the night, during work in the factory, or the like. An electronic timepiece with a vocal announcing device also finds wide utility for the blind people. In the prior art the electronic timepiece with the vocal announcing device uses digital write-in and read-out system, and can perform fine vocal announcement through small type of an electronic circuit.

SUMMARY OF THE INVENTION

Accordingly, it is a general object of the present invention to provide a vocal announcing device for an electronic timepiece which cannot perform only vocal announcement of an indicated time or an alarming action at a set time in the prior art but also perform background sounds overlapping the vocal announcement so that the vocal announcement can be made in multiplicity and high quality for listeners' ears.

In the present invention it is preferred that the background sounds mentioned in the above is a desired melody, or voices of the birds such as cuckoo, etc.

BRIEF DESCRIPTION OF DRAWING

FIGURE is a block diagram showing a preferred embodiment of a vocal announcing device for an electronic timepiece in accordance with the teachings of the present invention.

DETAILED DESCRIPTION OF PREFERRED EMBODIMENT

In FIGURE, shown therein is a block diagram of a vocal time announcing device for an electronic timepiece in accordance with the teachings of the present invention.

A high frequency signal from an oscillator 10 including crystal oscillator, etc. is converted into desired pulse row divided by a divider 12, and the pulse row with a period of one second is supplied to a second counter 14, which is composed of modulo 60 counter to supply minute pulses with a period of 60 seconds to a minute counter 16. The minute counter 16 is also composed of modulo 60 counter, the output of which is hour pulses being supplied to an hour counter 18 composed of modulo 12 counter.

In order to perform vocal time announcement of indicated time, the count values of the minute counter 16 and the hour counter 18 is supplied to a digital multiplexer 20. At the same time, to the digital multiplexer 20 a code signal reading out the voice of "minutes" or "o'clock" from a voice memory section, which will be described later, is supplied from a minute code ROM 22 and an o'clock code ROM 24.

A voice selective signal put out from the digital multiplexer 20 is supplied to a voice signal generating circuit 26, and the voice signals corresponding to an indicated time are provided to a speaker 32 by way of a mixer 28 and an amplifier 30. Accordingly, the indicated time is announced through the speaker 32 by the voice selected by the digital multiplexer 20. The voice signal generating circuit 26 includes a memory section consisting in a voice ROM 34 which memorizes the voice as digital signal, and in the voice ROM 34 are memorized the time numeral voices of zero through fifty-nine and the voices of "minutes" and "o'clock" so that the voice signals are selected corresponding to an indicated time in accordance with the voice selective signals from the digital multiplexer 20. In the embodiment, the voice signal generating circuit 26 reads out the signals from the voice ROM 34 one after another in accordance with the voice selective signals from the digital multiplexer 20, and the voice signal generating circuit includes a start address ROM 36, an end address ROM 38, an address counter 40 and a digital comparator 42. The selective signals of start address and the end address from the digital multiplexer 20 are memorized in both ROM's 36 and 38. The selective signals are memorized in the order of output signals from the multiplexer 20.

In case of the indicated time of 12:35, for example, from the digital multiplexer 20 "twelve" of the hour counter 18 is memorized as the selective signal in the start address ROM 36 and the end address ROM 38. The start address of the ROM 36 selects the start address of voice signal "twelve" from a voice ROM 34 by way of an address counter 40. This voice signal is made access to be converted into analog signal by a D/A converter 44, and put out to the mixer 28 after unnecessary harmonics are removed by a low pass filter 46. The access of the voice ROM 34 is continued until the present address is met with the end address. The present address is, accordingly, compared with the end address of the end address ROM 38 in the digital comparator 42 one after another. The present address is met with the end address to complete the read-out of the voice signal "twelve" and moves into the following voice signal read-out process.

In order to renewably supply the selective signals from the digital multiplexer 20 to the voice signal generating circuit 26 one after another, count signals are supplied from a modulo 7 counter 48 to the digital multiplexer 20. In the reset state of the module 7 counter 48 the digital multiplexer 20 selects the signal from the hour counter 18 by the signal of the counter 48. Once the output of this voice signal is completed, the modulo 7 counter 48 counts plus 1 by way of a one-shot circuit 50 so that the digital multiplexer 20 supplys the signal of the hour code ROM 24 of the selective signal of "o'clock" to the voice signal generating circuit 26. In the same manner, the voice signals of "thirty-five" and "minutes" are read out one after another.

The read-outs of the above mentioned voice signals can be determined at optional time interval by an operation of a time announcing switch. In the embodiment they are determined at one minute interval. In other words, in FIGURE, the minute pulses of the second counter 14 are supplied to an OR gate 54 as one minute interval signals by way of the one-shot circuit 52. In the same manner, the time announcing signals are supplied from the time announcing switch 56 to the OR gate 54 at an optional interval. The time announcing trigger signals of the OR gate 54 are supplied to a reset terminal of the modulo 7 counter 48 by way of the one-shot circuit 58 as well as they opens an AND gate 62 by way of a flip-flop 60. The other input terminal of the AND gate 62 is supplied address pulses from the divider 12, and the address pulses are supplied to the address counter 40 of the voice signal generating circuit 26, when the AND gate 62 is opened, so that the voice signals are read out from the afore-mentioned voice ROM 34. The indicated time is, therefore, announced through the speaker 32 at one minute period, and the operation of the time announcing switch 56 can determine the announcement of the indicated time at optional interval.

In the present invention, background sounds can be performed to overlap the vocal announcement. In order to enable this, equipped is a background sound signal generating circuit 64, which includes a background ROM 66, and in which desired background sounds of melody, the voices of cuckoo or the like are kept to be memorized as digital signals. The memorized signals of the background sound ROM 66 is read out by the address signal of an address counter 68 which is accessed by the output of the AND gate 62. This digital signal is converted into the analog signal by a D/A convertor 70, and, further, supplied to the mixer 28 by way of a low pass filter 72. The mixer 28 mixes the voice signal from the voice signal generating cirduit 26 with the background sound from the background sound generating cirduit 64 so that the speaker 32 is driven by way of the amplifier 30. Consequently, the vocal time announcement and the background sounds are overlappingly announced through the speaker 32, and users can enjoy the comfortable vocal time announcement of the indicated time together with the background sounds.

In the afore-mentioned embodiment, the present invention is described in accordance with the announcement of the indicated time, but the present invention can, further, be adapted to a timepiece which performs vocal alarming action at a set time, and can provide vocal alarming sounds in high quality and multiplicity by means of the performance of background sounds overlapping the vocal alarming sound of the timepiece.

As described heretofore, according to the present invention, vocal announcement can be made in multiplicity and in high quality since the vocal announcement at the indicated time and the background sounds can be overlappingly performed at the same time, and the present invention finds wide utility in the electronic timepiece having vocal announcing device.

Incidentally, in the embodiment the background sounds is overlappingly announced continuously during the vocal time announcement, but it is possible to overlap the background sounds partially during the vocal time announcement, at the beginning of the announcement or the end of the announcement, for example.

What is claimed is:

1. A vocal announcing device for an electronic timepiece wherein background sounds are overlappingly performed with vocal announcement during vocal announcement in a timepiece with vocal announcing device which announces indicated time or performs alarming action by voice signals, said device comprising:

a voice memory section which memorizes voices as digital signals;

a voice signal generating circuit which at least includes a first address counter that reads out in a fixed order a content memorized in said voice memory section and said circuit further includes a converting section which converts digital signals supplied by said voice memory section into analog signals;

a background sound memory section which memorizes background sounds as digital signals;

a background sound signal generating circuit including second address counter which reads out in a fixed order a content memorized in said background sound memory section and said circuit further includes a converting section which converts digital signals supplied by said background sound memory section into analog signal; and action controlling section which makes said first and second address counters operate overlappingly at an optional interval or at an indicated time.

* * * * *